US006005335A

United States Patent [19]

Potter

[11] Patent Number: 6,005,335

[45] Date of Patent: Dec. 21, 1999

[54] SELF-GETTERING ELECTRON FIELD EMITTER

[75] Inventor: Michael D Potter, Churchville, N.Y.

[73] Assignee: Advanced Vision Technologies, Inc., W. Henrietta, N.Y.

[21] Appl. No.: 08/990,624

[22] Filed: Dec. 15, 1997

[51] Int. Cl.[6] ..... H01J 1/02; H01J 1/16; H01J 19/10; H01J 1/62

[52] U.S. Cl. ..... 313/309; 313/336; 313/351; 313/495

[58] Field of Search ..... 313/309, 336, 313/351, 495–497, 549, 553, 558, 561

[56] References Cited

U.S. PATENT DOCUMENTS

| | | | |
|---|---|---|---|
| 4,041,316 | 8/1977 | Todokoro et al. | 250/396 R |
| 5,063,323 | 11/1991 | Longo et al. | 313/309 |
| 5,223,766 | 6/1993 | Nakayama et al. | 313/495 |
| 5,453,659 | 9/1995 | Wallace et al. | 313/495 |
| 5,498,925 | 3/1996 | Bell et al. | 313/497 |
| 5,502,348 | 3/1996 | Moyer et al. | 313/310 |
| 5,520,563 | 5/1996 | Wallace et al. | 445/24 |
| 5,545,946 | 8/1996 | Wiemann et al. | 313/497 |
| 5,578,900 | 11/1996 | Peng et al. | 313/495 |
| 5,606,225 | 2/1997 | Levine et al. | 315/169.3 |
| 5,610,478 | 3/1997 | Kato et al. | 315/169.1 |
| 5,614,785 | 3/1997 | Wallace et al. | 315/496 |
| 5,618,216 | 4/1997 | Potter | 445/24 |
| 5,630,741 | 5/1997 | Potter | 445/24 |
| 5,635,795 | 6/1997 | Itoh et al. | 313/496 |
| 5,644,188 | 7/1997 | Potter | 313/309 |
| 5,644,190 | 7/1997 | Potter | 313/336 |
| 5,647,998 | 7/1997 | Potter | 216/24 |
| 5,656,889 | 8/1997 | Niiyama et al. | 313/553 |

OTHER PUBLICATIONS

Walter H. Kohl "Handbook of Materials and Techniques for Vacuum Devices" Reinhold Publishing Corp., New York 1967, Chapter 18 "Getter Materials" pp. 545–562.

*Primary Examiner*—Nimeshkumar D. Patel
*Assistant Examiner*—Mack Haynes
*Attorney, Agent, or Firm*—Theodore R. Touw

[57] ABSTRACT

A self-gettering electron field emitter has a first portion formed of a low-work-function material for emitting electrons, and it has an integral second portion that acts both as a low-resistance electrical conductor and as a gettering surface. The self-gettering emitter is formed by disposing a thin film of the low-work-function material parallel to a substrate and by disposing a thin film of the low-resistance gettering material parallel to the substrate and in contact with the thin film of the low-work-function material. The self-gettering emitter is particularly suitable for use in lateral field emission devices. The preferred emitter structure has a tapered edge, with a salient portion of the low-work-function material extending a small distance beyond an edge of the gettering and low resistance material. A fabrication process specially adapted for in situ formation of the self-gettering electron field emitters while fabricating microelectronic field emission devices is also disclosed.

18 Claims, 4 Drawing Sheets

SELF-GETTERING ELECTRON FIELD EMITTER

CROSS REFERENCE TO RELATED APPLICATIONS

This application is related to another application by Michael D. Potter, titled "Fabrication Process for Self-Gettering Electron Field Emitter," filed in the United States Patent and Trademark Office on Ser. No. 08/990,087, and Dec. 15, 1997.

FIELD OF THE INVENTION

This invention relates generally to microelectronic devices utilizing field emission and fabrication methods for such devices, and more particularly to fabrication of electron field emitter structures having self-gettering properties.

BACKGROUND OF THE INVENTION

A difficult challenge in fabricating electron field-emission arrays, such as those used in field-emission displays, is providing a getter material effective for preventing the electron emitters from becoming contaminated. Typically in field-emission displays, a getter material is placed at the outer edge of the entire array. Since the width and length of a typical display can be several tens of centimeters, and the distance between the emitter and anode of each cell is typically on the order of only 50 to 200 micrometers, a getter material can be disposed too far away from many emitters of the array to effectively getter decomposition products or outgassed species. The result can be contamination of the emitter, causing changes in work function, with resulting catastrophic failure of the field-emission array.

NOTATIONS AND NOMENCLATURE

In this specification, the term "nitrided" as applied to metals, for example "nitrided tantalum" or "nitrided molybdenum" will refer not only to a stoichiometric nitride compound such as TaN, $Ta_2N$, MoN, or $Mo_2N$, but also to non-stoichiometric partially nitrided metal, i.e. a metal to which an amount of nitrogen has been added, though not necessarily an amount necessary to form a stoichiometric compound. Formulas for such materials are often written as $MoN_x$ or $Ta_xN$, for example. It is known in the art that various amounts of nitrogen can be introduced into thin films of metals, for example by reactive sputtering or ion implantation, to produce non-stoichiometric nitrided compositions.

The term "lateral" in this specification refers generally to a direction parallel to a substrate on which an electronic device is formed. Thus a "lateral field-emission device" refers to a field-emission device formed on a substrate and formed with a structure such that an anode is spaced apart from a field emitter along at least a direction parallel to the substrate. Similarly, the term "lateral emitter" refers to a field emitter made substantially parallel to the substrate of a lateral device, whereby emission of electrons toward the anode occurs generally parallel to the substrate. Examples of such lateral emitters formed of thin films are known in the related art.

While some authorities have restricted the term "gettering" to mean clean-up of residual gases and gas or other contaminants produced during processing of devices, and have used the term "keeping" to mean the clean-up of gas or other contaminants produced during life of the devices, the term "gettering" in this specification and the appended claims is intended to encompass all such applications. The term "contaminants" is intended to encompass any unintended or unwanted substance that can affect the electron emission from an emitter of a electron field emission device. Such contaminants may be atoms, molecules, atom clusters, ions, free radicals, etc. Common potential molecular contaminants include, for example, $O_2$, $H_2$, $SO_2$, $N_2$, $NH_3$, $CO_2$, CO, $H_2O$, $C_2H_2$, $C_2H_4$, $CH_4$, $SF_6$, and $CCl_2F_2$.

DESCRIPTION OF THE RELATED ART

Many field-emission device structures are known, of which it appears a majority have been generally of the Spindt type, as described for example in U.S. Pat. No. 3,755,704. The following U.S. patents describe various field emission devices having lateral field emitters and/or their fabrication processes: Cronin et al. U.S. Pat. Nos. 5,233,263 and 5,308,439; Xie et al. U.S. Pat. No. 5,528,099; and Potter U.S. Pat. Nos. 5,616,061, 5,618,216, 5,628,663, 5,630,741, 5,644,188, 5,644,190, 5,647,998, 5,666,019, 5,669,802, 5,700,176, and 5,703,380.

The use of getter pumping to remove gases from an environment has been known for many years. More recently, gettering has been used in field-emission devices with various methods and arrangements to prevent the electron-emitting tip from being contaminated.

U.S. Pat. No. 4,041,316 to Todokoro et al. discloses a field emission electron gun with an evaporation source, the evaporating material from which forms evaporation layers on the inner surface of the vacuum chamber and the anode surface. Reactive gases adhering to and embedded into the inner surface of the vacuum chamber and the anode are suppressed from being drawn out by electron bombardment.

U.S. Pat. No. 5,063,323 to Longo et al. discloses a structure providing passageways for venting of outgassed materials. Outgassed materials, liberated in spaces between pointed field emitter tips and an electrode structure during electrical operation of a field emitter device, are vented through passageways to a pump of gettering material provided in a separate space.

U.S. Pat. No. 5,223,766 to Nakayama et al. discloses a thin type of image display device for displaying an image by emitting light from a phosphor upon irradiation with electron beams. The device has a cathode panel between a front panel and a back panel in such a manner that a space exists between the cathode panel and the back panel. Through-holes for diffusion of getters are formed in the cathode panel to maintain the image quality at the center of a display screen, or the cathode panel is supported by getters to maintain a required pressure for attaining a higher image quality even on a large-sized display screen. A gate electrode in this device may be composed of a getter material.

U.S. Pat. Nos. 5,453,659 and 5,520,563 to Wallace et al. disclose an anode plate for use in a field emission flat panel display having integrated getter material. The anode plate comprises a transparent planar substrate having a plurality of electrically conductive, parallel stripes comprising the anode electrode of the device. The stripes are covered by phosphors, and there is a gettering material in the interstices of the stripes. The gettering material is preferably zirconium-vanadium-iron or barium.

U.S. Pat. No. 5,498,925 to Bell et al. discloses a flat panel display apparatus which includes spaced-apart first and second electrodes, with a patterned solid material layer in contact with one of the electrodes, exemplarily between the two electrodes. The patterned layer (referred to as the "web") includes a multiplicity of apertures, with at least one aperture associated with a given pixel. In the aperture is disposed a quantity of a second material, exemplarily, a phosphor in the case of an FPFED, or a color filter material in the case of a LCD. The web can include getter or hygroscopic material.

U.S. Pat. No. 5,502,348 to Moyer et al. discloses a ballistic charge transport device with integral active contaminant absorption means. The ballistic charge transport device includes an edge electron emitter defining an elongated central opening through it, with a receiving terminal (e.g. an anode) at one end of the opening and a getter at the other end. A suitable potential is applied between the emitter and the receiving terminal to attract emitted electrons to the receiving terminal, and a different suitable potential is applied between the emitter and the getter so that contaminants, such as ions and other undesirable particles, are accelerated toward and absorbed by the getter.

U.S. Pat. No. 5,545,946 to Wiemann et al. discloses a field emission display which includes an insulating layer and an emitting layer disposed on the faceplate. A vacuum chamber is disposed between a backplane and the emitting layer and contains a getter. Apertures are defined through the insulating layer and the emitting layer for communicating contaminants from the faceplate to the vacuum chamber.

U.S. Pat. No. 5,578,900 to Peng et al. discloses a field emission display having a built-in ion pump for removal of outgassed material. Ion pump cathode electrodes formed of a gettering material cover the gate electrodes, so that during display operation, the outgassed material is collected at the ion pump cathode electrodes. Alternately, the ion pump cathode may be formed on a focusing electrode, on a focusing mesh, or on other electrode structures.

U.S. Pat. No. 5,606,225 to Levine et al. discloses a tetrode arrangement for a color field-emission flat panel display with barrier electrodes on the anode plate. The anode plate includes a transparent planar substrate having on it a layer of a transparent, electrically conductive material, which comprises the anode electrode of the display tetrode. Barrier structures comprising an electrically insulating, preferably opaque material, are formed on the anode electrode as a series of parallel ridges. Atop each barrier structure are a series of electrically conductive stripes, which function as deflection electrodes. The conductive stripes are formed into three series such that every third stripe is electrically interconnected. The deflection electrodes may be formed of a conductive material having gettering qualities, such as zirconium-vanadium-iron.

U.S. Pat. No. 5,610,478 to Kato et al. discloses a method of conditioning emitters of a field emission display to improve electron emission. Emitters and rows are operated at voltages that stimulate electron emission from the emitters. An anode is operated at a voltage that does not attract electrons so that the electrons are attracted to the rows.

U.S. Pat. No. 5,614,785 to Wallace et al. discloses an anode plate for flat panel displays having a silicon getter. The display device includes a transparent substrate having a plurality of spaced-apart, electrically conductive regions forming the anode electrode, covered by a luminescent material. A getter material of porous silicon is deposited on the substrate between the conductive regions of the anode plate. The getter material of porous silicon is preferably electrically nonconductive, opaque, and highly porous.

U.S. Pat. No. 5,635,795 to Itoh et al. discloses a getter chamber for flat panel displays. A fluorescent display device includes an air-tight envelope having a cathode substrate, an anode substrate with a phosphor layer arranged to provide a luminous display, a seal member, an evacuation hole formed at a side of the envelope, and a getter chamber in communication with the hole. The getter chamber is disposed on the outside of the envelope and includes a chamber body and an evacuation tube. The getter chamber eliminates the independent formation of an evacuation hole in the cathode substrate and thereby prevents damage and contamination of the cathode substrate.

U.S. Pat. No. 5,656,889 to Niiyama et al. discloses a getter device capable of being re-activated as required and arranged in a narrow space in an envelope. The getter is arranged in a layer-like manner in an envelope of an electronic element to provide, in the envelope, a film-like getter for keeping the interior of the envelope at a vacuum. Electrons emitted from an electron feed section are impinged on the getter to activate it.

Thus several field-emission devices of the background art have included gettering material associated with the inner surface of vacuum chamber walls or associated with the anode, gate, or deflection electrodes of the devices.

PROBLEMS SOLVED BY THE INVENTION

There are many sources of contamination that can affect the performance of electron field emitters, including the outgassing of materials used in fabrication of the devices, electron-stimulated decomposition, electron-stimulated desorption, residual gases present in vacuum systems used during device fabrication, and permeation of gases into the ambient environment of the field emitter. The present invention provides improved means for preventing contamination of electron field emitters, thus preventing undesired changes in the electron field emitters' work functions, which can otherwise cause improper functioning of the field-emission devices or arrays of such devices.

OBJECTS AND ADVANTAGES OF THE INVENTION

A main purpose of the invention is preventing an electron field emitter from becoming contaminated and thus preventing undesirable changes in the field emitter's work function. Thus a general object is a more reliable electron field emitter device. Therefore, one object of the invention is gettering potentially contaminating atoms, molecules, and ions from an evacuated space or ambient gas near an electron field emitter and especially near the field emitter's emitting tip. A particular object is providing a self-gettering electron field emitter. A similar object is providing a gettering material integral with an electron field emitter. A related object is a getter that will automatically have the same negative potential as the emitter, for improving the attraction and gettering of positive ions, and for avoiding electron-stimulated desorption of gettered species. Another related object is a self-gettering emitter in which the emitting portion includes a nitrided form of a material composing the gettering portion. Another object is a fabrication process for microelectronic devices having self-gettering electron field emitters. A related object is a fabrication process specially adapted for in situ formation of self-gettering electron field emitters while fabricating microelectronic field emission devices. These and other objects are realized by the invention, as will become clear from a reading of this specification and the appended claims along with the drawings.

BRIEF SUMMARY OF THE INVENTION

A self-gettering electron field emitter has a first portion formed of a low-work-function material for emitting electrons, and it has an integral second portion that acts both as a low-resistance electrical conductor and as a gettering surface. The self-gettering emitter is formed by disposing a thin film of the low-work-function material parallel to a substrate and by disposing a thin film of the low-resistance gettering material parallel to the substrate and in contact with the thin film of the low-work-function material. The self-gettering emitter is particularly suitable for use in lateral field emission devices. The preferred emitter structure has a tapered edge, with a salient portion of the low-work-function material extending a small distance beyond an edge of the gettering and low resistance material. A fabrication process specially adapted for in situ formation of the self-gettering electron field emitters while fabricating microelectronic field emission devices is also disclosed.

DETAILED DESCRIPTION OF THE PREFERRED EMBODIMENTS

The following detailed description, to be read with reference to the drawings, begins with a detailed description of a preferred embodiment of the electron field emission device made in accordance with the invention. The device description is followed by a detailed description of a preferred fabrication process. The device drawings are not drawn to scale; in particular, the vertical dimensions are greatly exaggerated relative to the horizontal dimensions.

Figure 1:
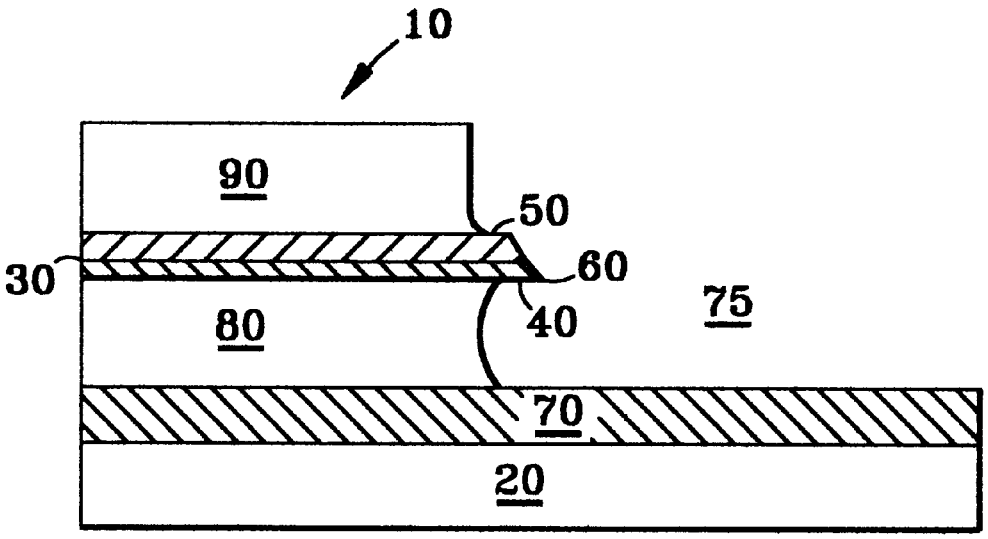
FIG. 1 shows a cross-sectional side elevation view of an electron field emitter device made in accordance with the invention.

FIG. 1 shows a cross-sectional side elevation view of the electron field emitter device 10, made on a substrate 20. A emitter 30 consists of an emitting portion 40 and a gettering portion 50. Emitting portion 40 is a thin layer of a substance with a low work function, preferably parallel to substrate 20 to form part of a lateral field emitter. Gettering portion 50 is a thin layer of a gettering substance disposed at least partially contiguous to emitting portion 40, preferably parallel to substrate 20 and to emitting portion 40. Gettering portion 50 acts both as a low-resistance electrical conductor and as a gettering surface. Emitting portion 40 and gettering portion 50 together form an integrated self-gettering electron field emitter 30. Emitter 30 has an extremely fine emitting tip 60. An anode 70 is spaced apart from emitter 30. When anode 70 is suitably biased positively with respect to emitter 30 to create a high electric field at emitting tip 60, electrons emitted from emitting tip 60 in accordance with the Fowler-Nordheim equation are attracted to anode 70. Thus anode 70 receives electrons emitted from emitter 30's emitting tip 60, or more specifically from emitting portion 40. If anode 70 is formed with at least its surface consisting of a cathodoluminescent phosphor substance, light is emitted from anode 70 when excited by the electrons. Anode 70 may consist entirely of a conductive phosphor. Emitter 30 is preferably insulated from anode 70 by an insulating layer 80. Emitter 30 is also preferably covered by another insulating layer 90. The preferred structure shown in FIG. 1 is a lateral-emitter device, in which field emitter 30 extends laterally, parallel to substrate 20.

Because electron field emission in accordance with the Fowler-Nordheim equation is very sensitive not only to the radius but also to the work function of fine emitting tip 60, the emitting portion 40 of emitter 30 preferably has a low work function. Many known materials are suitable for emitting portion 40. The refractory transition metals, such as titanium, zirconium, hafnium, vanadium, niobium, tantalum, chromium, molybdenum, or tungsten, may be used. Field emitter tips have also been made from silicon, carbon (especially in the form of diamond), lanthanum hexaboride, and other materials. In the structure of the present invention, emitting portion 40 is preferably made of a nitrided form of the transition metals listed above, most preferably nitrided titanium, nitrided tantalum, or nitrided molybdenum. For some applications, an alternative embodiment may be used, having emitting portion 40 made of diamond (carbon having a diamond crystal structure), doped with one or more N-type dopants to provide a low work function emitter.

A very important feature of the preferred structure shown in FIG. 1 is the location of gettering portion 50 as close as possible to emitting portion 40 of the integrated emitter structure 30, and especially as close as possible to emitting tip 60. Gettering portion 50 is made of a substance capable of gettering undesirable gases which could contaminate emitting portion 40. Preferably the gettering material should be a substance reactive to the contaminant substances.

Many substances known to be generally useful for gettering are listed in references, including the following: the chapter "Getters" by E. P. Bertin in "The Encyclopedia of Chemistry" 2nd edition (G. L. Clark et al. eds.) Reinhold Publishing, New York (1966), pp. 484–485; the book by S. Dushman, "Scientific Foundations of Vacuum Technique" 2nd edition, John Wiley & Sons, New York (1962) pp. 174–175; and Chapter 18, "Getter Materials" in W. H. Kohl, "Handbook of Materials and Techniques for Vacuum Devices" Reinhold Publishing, New York (1967) pp. 545–562. Substances discussed in these references include aluminum, barium, beryllium, calcium, cerium, copper, cobalt, iron, the lanthanide elements, magnesium, misch metal, nickel, palladium, thorium, uranium, zinc, titanium, zirconium, hafnium, vanadium, niobium, tantalum, chromium, molybdenum, tungsten, and their suitable alloys, combinations, and mixtures. In general, any of these or other known gettering substances may be used for gettering portion 50 of emitter 30. The preferred materials for gettering portion 50 are the refractory transition metals titanium, zirconium, hafnium, vanadium, niobium, tantalum, chromium, molybdenum, tungsten, and their alloys, combinations, and mixtures (most preferably zirconium).

It is worth noting that there is some advantage to using a transition metal in its pure form as a gettering portion 50, integrated with the nitrided form of that same metal as the emitting portion 40. During fabrication the nitrided form and the pure form of the metal can be deposited sequentially by suitably introducing or withholding nitrogen. However, particular applications of the device may influence the choice of materials. A preferred nitrided metal used for emitting portion 40 due to other considerations, such as work function, may result in a different metal included in gettering portion 50. Thus, if the preferred refractory transition metals and their nitrided forms are used, those may be of the same metal or different metals. The preferred combinations are zirconium for gettering portion 50 and nitrides of titanium, tantalum, molybdenum, or their mixtures or alloys for emitting portion 40.

Figure 2:
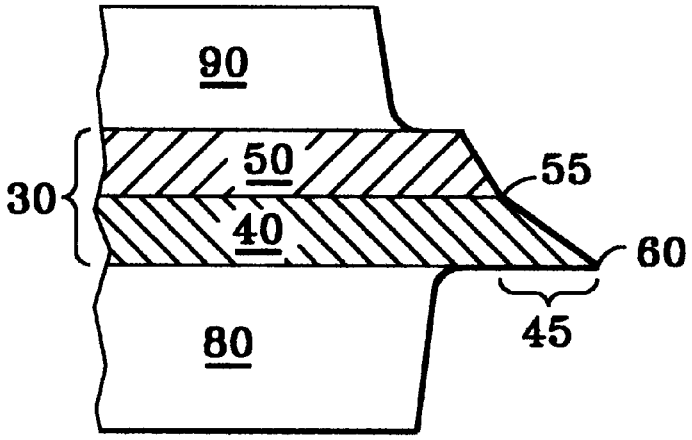
FIG. 2 shows a cross-sectional side elevation view of a detail of the electron field emitter of FIG. 1.

FIG. 2 shows a cross-sectional side elevation view of emitting tip 60. Emitter 30 preferably has a tapered edge which determines the shape of emitting tip 60. Emitting tip 60 is preferably made by forming the gettering portion 50 with an edge 55 and forming the emitting portion 40 with a salient part 45 extending beyond the edge 55 of the gettering portion to form emitting tip 60. While FIG. 1 shows anode 70 near the bottom of the final structure (as it typically would be if it were a phosphor for display applications), this arrangement is for illustrative purposes only. Similarly, FIGS. 1 and 2 show the emitting portion 40 of emitter 30 below gettering portion 50, but this arrangement is also only illustrative. The reverse order of these layers (or other spatial arrangements preserving the contiguous relationship of the gettering and emitting portions) would also be functional. An overall device structure such as the structure shown in FIG. 1 and an emitting tip structure like that of FIG. 2 are formed in the preferred fabrication process described in detail below.

Preferred Fabrication Process

Figure 3:
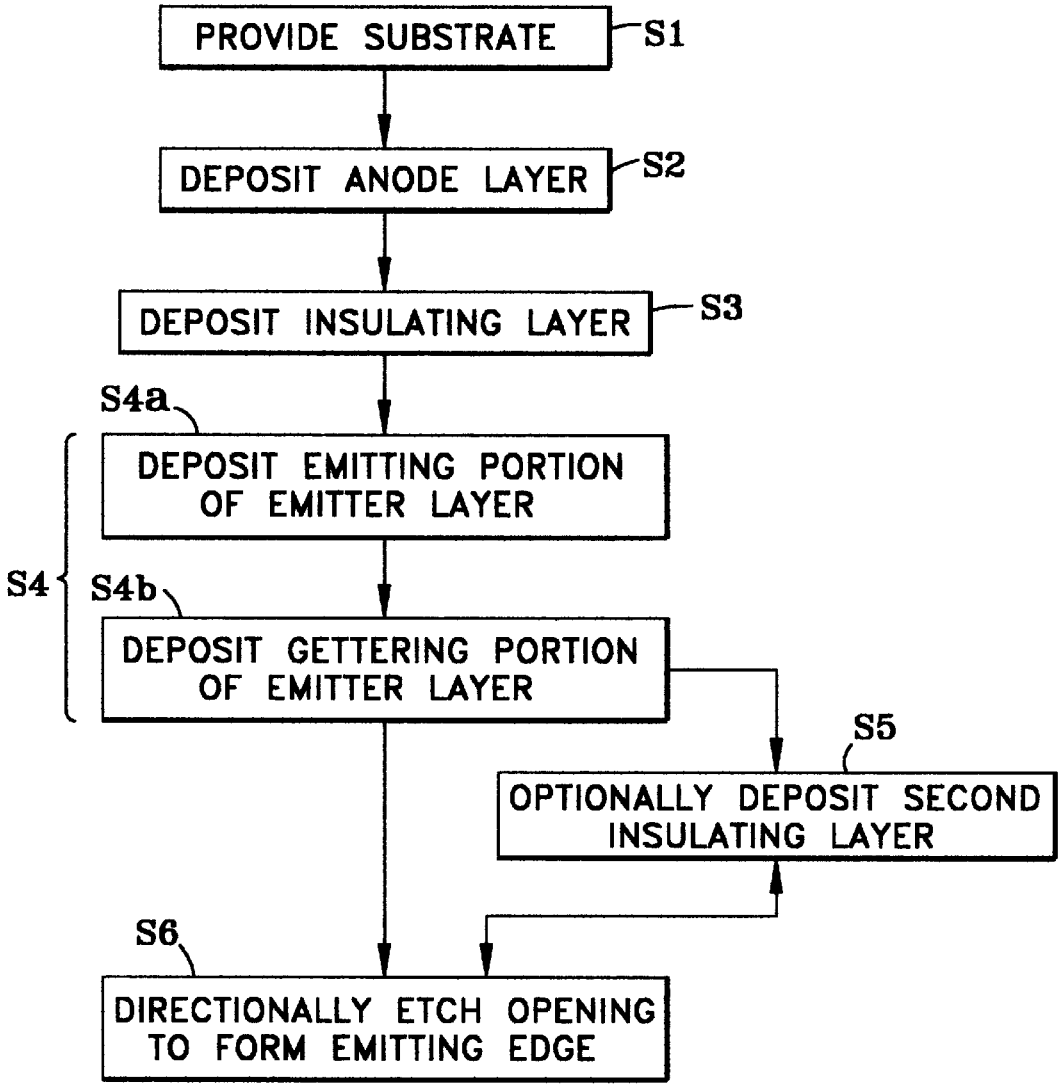
FIG. 3 shows a flow diagram illustrating steps of a preferred fabrication process.

FIG. 3 shows a flow diagram illustrating steps of a preferred fabrication process, and FIGS. 4*a*–4*e* show a sequence of cross-sectional side elevation views of the device at various stages during its fabrication. Process steps are denoted by reference numerals S1, S2, . . . , S6.

An overall fabrication process includes the steps of providing a substrate, disposing an integrated emitter with an emitter layer and a gettering layer parallel to the substrate, etching through the emitter layer and gettering layer to form an emitting edge on the integrated emitter, disposing an anode spaced apart from the emitting edge for receiving electrons to be emitted from the emitting edge, and providing means for applying a suitable electrical bias voltage to the emitter and anode. In practice, additional steps typically provide for insulating layers as well. Steps of the preferred process are described in detail in the following paragraphs, referring to FIG. 3 and FIGS. 4*a*–4*e*.

In step S1, a suitable substrate 20, such as silicon, silicon oxide, silicon nitride, glass, or sapphire, is provided. In step S2, an anode layer 70 is deposited on the substrate (FIG. 4*a*) and is optionally patterned. If all the field emission devices on the substrate are to share a common anode, no patterning is needed. The optional substep of patterning is not shown in the drawings. In general, anode layer 70 may be made of any suitable conductive material, deposited in a suitable thickness (e.g. 100 nanometers). For display applications, at least the surface of anode layer 70 should be a cathodoluminescent phosphor. Many cathodoluminescent phosphors having various properties such as colors of light emission, luminous efficiencies, stability, etc. are known in the art. Several suitable phosphors are described in U.S. Pat. Nos. 5,618,216; 5,630,741; 5,644,188; 5,644,190; and 5,647,998 to Potter, the entire disclosure of each of which is incorporated herein by reference. In one version of the preferred process, the anode is zinc oxide (ZnO) with an amount of Zn in excess over a stoichiometric amount (usually denoted ZnO:Zn), for producing a display device emitting green light. In another version of the preferred process, $Ta_2Zn_3O_8$ phosphor is disposed on at least the surface of the anode, for producing a display device emitting blue light.

In step S3, an insulating layer 80 of predetermined thickness is deposited, preferably parallel to substrate 20 (FIG. 4*b*), to provide an insulating spacing between anode layer 70 and subsequent elements of the device. Insulating layer 80 may be made of any suitable insulator compatible with the other steps of the process, such as silicon oxide, silicon nitride, aluminum oxide, etc. In the preferred process, insulating layer 80 is silicon oxide. A preferred thickness is about 500 nanometers.

Figure 4A:
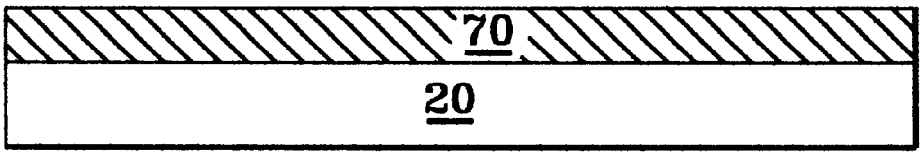
FIGS. 4*a*–4*e* show a series of cross-sectional side elevation views of an electron field emitter device at various stages during its fabrication by a preferred process.
Figure 4B:
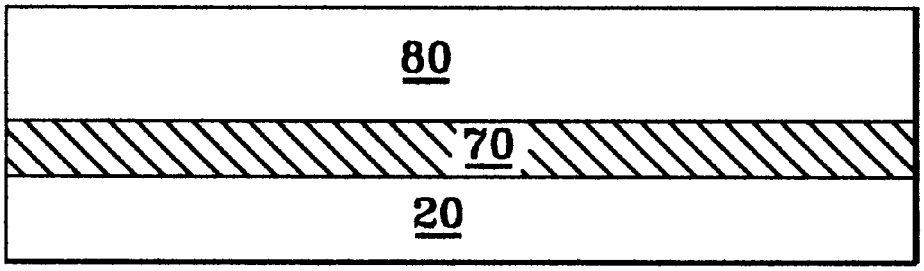
Figure 4C:
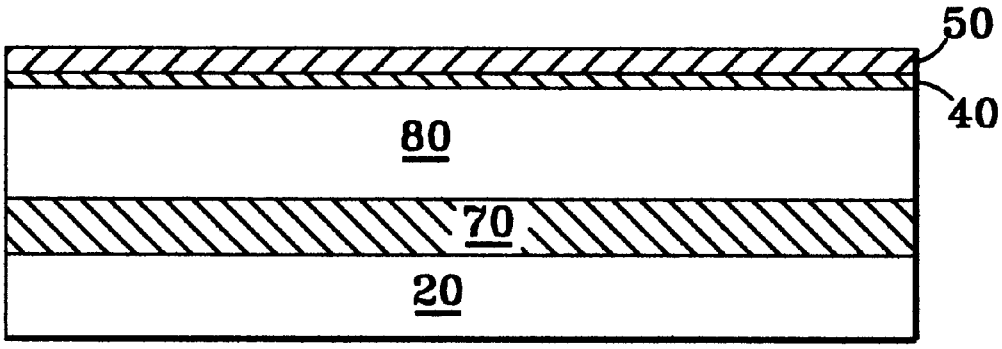

In the preferred fabrication process, self-gettering emitter 30 is made in situ while fabricating a microelectronic field emission device. In step S4, the self-gettering integrated emitter 30 is disposed over insulating layer 80, parallel with substrate 20 (FIG. 4*c*). In the most preferred embodiment, step S4 is performed in two substeps, S4*a* and S4*b*. In substep S4*a*, an emitting portion 40 is deposited, comprising a layer of a substance with low work function for electron emission. In step 4*b*, a gettering portion 50 is deposited, consisting of a layer of a gettering substance. The thickness of emitting portion 40 is preferably about 10–30 nanometers. The thickness of gettering portion 50 is preferably about 100–200 nanometers. Various materials suitable for each of these layers of the emitter are described above in the detailed description of the device structure. Deposition of the layers of emitter 30 may be done by any conventional deposition method suitable to the substance being deposited, such as evaporation, chemical vapor deposition, molecular beam deposition, plating, etc., instead of the preferred method of sputtering. The emitter 30 may be patterned in a conventional manner such as in the known photolithographic methods commonly used in semiconductor fabrication processes. Such patterning is described in the patents of Potter incorporated by reference hereinabove. This conventional patterning substep is not shown in the drawings. An important feature of the most preferred in situ process is realized when the two portions of the self-gettering emitter are based on refractory transition metals: a nitrided refractory transition metal deposited as the emitting portion 40 in substep S4*a*, and a layer of a refractory transition metal deposited as the gettering portion in substep S4*b*. The transition metal basis of these two portions may be different elements or may be based on the same element, e.g. nitrided titanium such as TiN as the emitting portion and pure titanium for the gettering portion, both based on titanium. A preferred example using different elements has an emitting portion comprising a nitrided form of titanium, tantalum, molybdenum, or their mixtures or alloys, and the gettering portion comprises zirconium metal. When the transition metal element is the same in the two portions of emitter 30, it is possible to deposit emitter 30 in a continuous process, by reactive sputtering of the metal in the presence of nitrogen to form the nitrided layer for emitting portion 40, and then by continuing to sputter the metal while withholding nitrogen to sputter the pure-metal gettering portion 50. With such a process, there is not necessarily a sharp boundary delineating the two portions 40 and 50; the nitrogen content can diminish more or less gradually from a relatively high level at emitter portion 40 to a low level, preferably zero, in gettering portion 50. A similar gradual variation of composition may be obtained even with different transition metals in the two portions 40 and 50, in cases where the two metals form solid solution alloys in the thin films.

Figure 5:
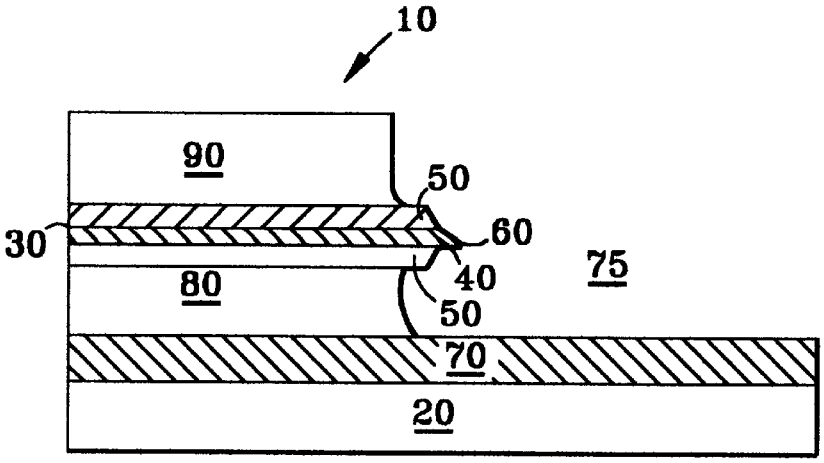
FIG. 5 shows a cross-sectional side elevation view of an alternate embodiment of the electron field emitter device.

While the preferred embodiment described herein has an emitter 30 having two layers 40 and 50, an alternate embodiment (shown in FIG. 5) has a laminar composite emitter having three layers: a medial emitting layer 40 and upper and lower gettering layers 50, one gettering layer above and one gettering layer below the emitting layer. Field emission device structures having three-layer composite lateral emitters (without the self-gettering feature) and their fabrication are described in detail in U.S. Pat. No. 5,647,998 to Potter, which is incorporated by reference hereinabove.

Figure 4D:
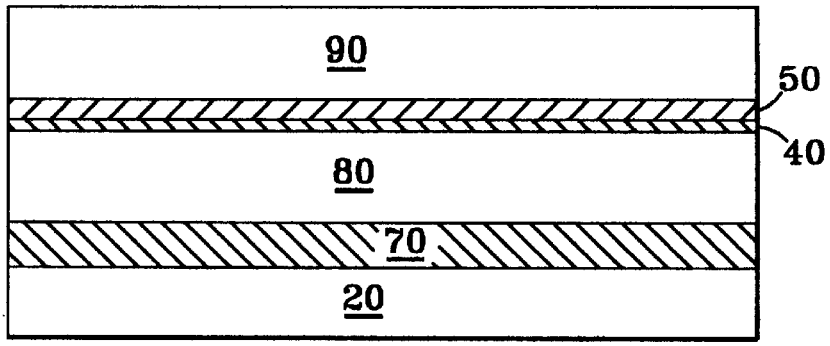

In step S5, a second insulating layer 90 is optionally deposited over emitter 30 (FIG. 4*d*). This second insulator may be of the same insulating material as layer 80, and may be about 50–200 nanometers thick. Silicon oxide is a preferred material. Insulating layer 90 protects the emitter and may provide an insulating spacer from the emitter for any gate electrode disposed above the plane of emitter 30 for controlling the electron current flowing from emitter tip 60 to anode 70.

Figure 4E:
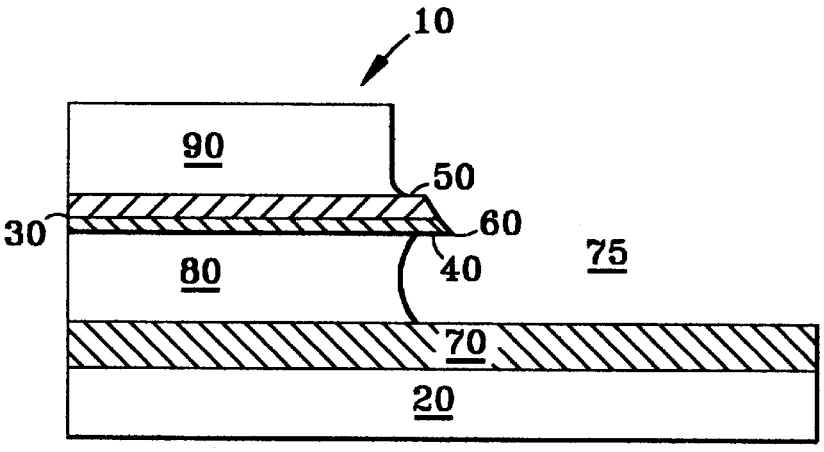

In step S6, a directional etch is performed through second insulating layer 90 if present, through both emitting layer 40 and gettering layer 50 of emitter 30, and through insulating layer 80, to form emitting edge 60 and to form an opening 75 that extends down to anode 70 (FIG. 4*e*). The width of opening 75 is not critical; a typical width is about 2–20 micrometers. The directional etch is preferably an anisotropic "trench" etch such as the reactive ion etching commonly used in semiconductor fabrication processes. This etching process preferentially etches the insulating layers 80 and 90 relative to its etching of the materials of emitter 30. While such an etch process is generally controlled to be highly anisotropic, it is preferably controlled to include some degree of isotropic etching in the present application. This creates the emitter structure shown in detail in FIG 2. The etching process of step S6 forms a thin emitting edge 60 on emitting portion 40 and forms an edge 55 on gettering portion 50 such that a salient portion 45 of the emitting portion 40 extends beyond edge 55, thus forming emitting tip 60 with the desired shape and self-gettering property. Since gettering portion 50 has a salient portion extending beyond the etched surface of insulating layers 80 and/or 90, the salient portion 45 of the emitter also extends beyond the surface of insulating layers 80 and/or 90. The exposed part of gettering portion 50 is positioned very favorably for gettering contaminants, immediately adjacent to emitting tip 60 and to the salient part 45 of emitting portion 40.

The formation of emitting tip 60 is preferably done while forming the trench opening 75, but may be done after forming that opening. A small amount of the supporting upper and/or lower gettering layer(s) 50 is removed, for example by etching in a plasma etch process. A differential etch process is chosen such that emitting portion 40 of the laminar emitter is less effected by the etch than the gettering portion(s) 50. This leaves an ultra thin emitter edge or tip 60. For some combinations of materials in the laminar composite emitter 30, a preferred differential etch process may be a chemical or electro-chemical etch, differential electropolishing, or differential ablation.

Once the device structure of FIG. 1 is formed, operation of the device requires means for applying a suitable electrical bias voltage to the emitter and anode, sufficient to cause emission of electrons from the emitter to the anode, in a conventional manner for field-emission devices. Thus the completed device has conductive contacts arranged to allow connection of the appropriate bias voltages from outside the device. Such conductive contact arrangements are described in the patents of Potter incorporated by reference hereinabove.

INDUSTRIAL APPLICABILITY

The invention is useful in fabrication of field emission devices and is especially useful for field emission displays that consist of an array of field emission devices, since each device in the array may have a self-gettering emitter. The preferred fabrication process is specially adapted for simultaneous fabrication of many devices in such an array. A self-gettering emitter made in accordance with the invention may also be used as an electron emitter part of an electron gun structure.

From the foregoing description, one skilled in the art can easily ascertain the essential characteristics of this invention, and without departing from the spirit and scope thereof, can make various changes and modifications of the invention to adapt it to various usages and conditions. Other embodiments of the invention will be apparent to those skilled in the art from a consideration of this specification or from practice of the invention disclosed herein. For example the order of steps of the fabrication process may be varied, and other suitable materials may be substituted for those described herein. While the preferred embodiment of the emitter has been described in a structure intended for displays, the self-gettering emitter may be made as an isolated element, for example by removing the substrate. It is intended that the specification and examples be considered as exemplary only, with the true scope and spirit of the invention being defined by the following claims.

Having described my invention, I claim:

1. An electron field-emission device formed on a substrate, said electron field-emission device including an emitter comprising:

a) a first layer of an electron-emitting substance, said first layer being disposed parallel to said substrate; and b) a second layer, said second layer being disposed parallel to said substrate and comprising a material capable of gettering contaminant substances, said second layer of said emitter having an edge, and said first layer of said emitter including a salient portion extending parallel to said substrate beyond said edge of said second layer to form an emitting tip of said first layer, whereby said material capable of gettering contaminant substances is disposed adjacent to said salient portion forming said emitting tip of said first layer.

2. An electron field-emission device as recited in claim 1, wherein said second layer of said emitter is disposed in direct contact with said first layer.

3. An electron field-emission device as recited in claim 1, wherein said first layer of said emitter has a low work function for electron emission.

4. An electron field-emission device as recited in claim 1, wherein said second layer of said emitter comprises a substance reactive to said contaminant substances.

5. An electron field-emission device as recited in claim 1, wherein said first layer of said emitter is characterized by having a smaller etch rate to a predetermined etchant than said second layer of said emitter, whereby said second layer of said emitter may be etched differentially from a portion of said emitter.

6. An electron field-emission device as recited in claim 1, wherein said second layer of said emitter comprises a transition metal.

7. An electron field-emission device as recited in claim 6, wherein said transition metal is selected from the list consisting of titanium, zirconium, hafnium, vanadium, niobium, tantalum, chromium, molybdenum, tungsten, and alloys, combinations, and mixtures thereof.

8. An electron field-emission device as recited in claim 1, wherein said second layer of said emitter comprises a substance selected from the list consisting of barium, beryllium, calcium, cerium, copper, cobalt, iron, the lanthanide elements, magnesium, misch metal, nickel, palladium, thorium, uranium, zinc, titanium, zirconium, hafnium, vanadium, niobium, tantalum, chromium, molybdenum, tungsten, and alloys, combinations, and mixtures thereof.

9. An electron field-emission device as recited in claim 1, wherein said first layer of said emitter comprises a nitrided transition metal.

10. An electron field-emission device as recited in claim 9, wherein said nitrided transition metal is selected from the list consisting of the nitrided forms of titanium, zirconium, hafnium, vanadium, niobium, tantalum, chromium, molybdenum, tungsten, and combinations and mixtures thereof.

11. An electron field-emission device as recited in claim 1, wherein said second layer of said emitter comprises a first transition metal and said first layer of said emitter comprises a nitrided second transition metal.

12. An electron field-emission device as recited in claim 11, wherein said first and second transition metals are the same.

13. An electron field-emission device as recited in claim 11, wherein said first and second transition metals are different.

14. An electron field-emission device formed on a substrate, said electron field-emission device comprising:

a) an emitter, said emitter comprising:

i) a first layer of an electron-emitting substance, said first layer being disposed parallel to said substrate; and ii) a second layer, said second layer being disposed parallel to said substrate and comprising a material capable of gettering contaminant substances, said second layer of said emitter having an edge, and said first layer of said emitter including a salient portion extending parallel to said substrate beyond said edge of said second layer to form an emitting tip of said first layer, whereby said material capable of gettering contaminant substances is disposed adjacent to said salient portion forming said emitting tip of said first layer;

b) an anode spaced apart from said emitter and disposed to receive electrons emitted from said first layer of said emitter; and c) means for applying electrical bias to said emitter and said anode suitable for causing electron field-emission from said first layer of said emitter.

15. An electron field-emission device formed on a substrate, said electron field-emission device comprising:

a) an emitter, said emitter comprising:

i) a first layer for gettering contaminant substances, said first layer comprising a first transition metal and being disposed parallel to said substrate; and ii) a second layer for emitting electrons, said second layer comprising a nitrided second transition metal and being disposed parallel to said substrate and in at least partial contact with said first layer, wherein said first layer of said emitter having an edge, and said second layer of said emitter including a salient portion extending parallel to said substrate beyond said edge of said first layer to form an emitting tip of said second layer, whereby said first layer capable of gettering contaminant substances is disposed adjacent to said salient portion forming said emitting tip of said second layer;

b) an anode spaced apart from said emitter and disposed to receive electrons emitted from the second layer of said emitter; and c) means for applying electrical bias to said emitter and said anode suitable for causing electron field-emission from said second layer of said emitter.

16. An electron field-emission device as recited in claim 15, wherein said first transition metal is zirconium, and said second transition metal is selected from the list consisting of titanium, tantalum, molybdenum, and combinations, mixtures, and alloys thereof.

17. An electron field-emission device of the type using a cold-cathode field-emission electron source, comprising:

a) a substrate having a substrate upper surface defining a first plane;

b) an anode;

c) a field-emission electron emitter spaced apart from said anode by a first predetermined distance and disposed on a second plane parallel to said first plane, said electron emitter comprising:

i) a thin film having upper and lower major surfaces disposed substantially parallel to said second plane, said thin film having a work function suitable for field emission of electrons, ii) a first gettering film disposed in contact with said upper major surface of said thin film, and iii) a second gettering film disposed in contact with said lower major surface of said thin film, at least one of said first and second gettering films being conductive;

d) a first conductive contact connected to said at least one of said first and second gettering films of said electron emitter to provide a cathode contact;

e) a second conductive contact spaced apart from said first conductive contact and connected to said anode to provide an anode contact, whereby said device may have an electrical bias voltage applied; and f) means for applying said electrical bias voltage.

18. An electron field-emission device as recited in claim 17, wherein said thin film of said emitter is characterized by having a smaller etch rate to a predetermined etchant than said first and second gettering films of said emitter, whereby said first and second gettering films of said emitter may be etched differentially from a portion of said emitter, thereby forming an edge on each of said first and second gettering films and forming a salient portion of said emitter extending beyond said edge of said first and second gettering films to provide a sharp emitting tip of said field-emission electron emitter.

* * * * *